US005850822A

United States Patent [19]

Romann et al.

[11] Patent Number: 5,850,822

[45] Date of Patent: Dec. 22, 1998

[54] INJECTION ARRANGEMENT FOR AN INTERNAL COMBUSTION ENGINE AND METHOD FOR FUEL INJECTION

[75] Inventors: Peter Romann, Stuttgart; Klaus-Henning Krohn, Bamberg; Jörg Lange, Eberdingen; Christof Vogel, Bischberg, all of Germany

[73] Assignee: Robert Bosch GmbH, Stuttgart, Germany

[21] Appl. No.: 849,041

[22] PCT Filed: Aug. 8, 1996

[86] PCT No.: PCT/DE96/01487

§ 371 Date: Jul. 29, 1997

§ 102(e) Date: Jul. 29, 1997

[87] PCT Pub. No.: WO97/12146

PCT Pub. Date: Apr. 3, 1997

[30] Foreign Application Priority Data

Sep. 26, 1995 [DE] Germany ..... 195 357 44.2

[51] Int. Cl.[6] ..... F02M 53/06; F02M 69/34; F02D 41/06

[52] U.S. Cl. ..... 123/549; 123/179.21

[58] Field of Search ..... 123/549, 557, 123/179.21, 472

[56] References Cited

U.S. PATENT DOCUMENTS

| | | | |
|---|---|---|---|
| 4,325,341 | 4/1982 | Yamauchi et al. | 123/549 |
| 5,050,571 | 9/1991 | Daniels | 123/557 |
| 5,119,775 | 6/1992 | Kokubo et al. | 123/179.21 |
| 5,284,117 | 2/1994 | Akase | 123/549 |
| 5,482,023 | 1/1996 | Hunt et al. | 123/491 |
| 5,529,035 | 6/1996 | Hunt et al. | 123/179.21 |
| 5,609,297 | 3/1997 | Gladigow et al. | 123/549 |

*Primary Examiner*—Marguerite McMahon
*Attorney, Agent, or Firm*—Kenyon & Kenyon

[57] ABSTRACT

A fuel injection arrangement for an internal combustion engine which has at least one combustion space and at least one intake pipe leading to this combustion space, with two fuel injection valves opening into the intake pipe upstream from at least one inlet valve. One fuel injection valve has a heater adapter. While only the fuel injection valve with the heater adapter is operated during cold start and the warm-up phase of the internal combustion engine, to a great extent, and the fuel injection valve without a heater is not in operation, a switch from one fuel injection valve to the other takes place at a point in time which is determined on the basis of the value of various operating parameters. The fuel injection arrangement is particularly suitable for use in mixture-compressing, outside-ignition internal combustion engines.

11 Claims, 1 Drawing Sheet

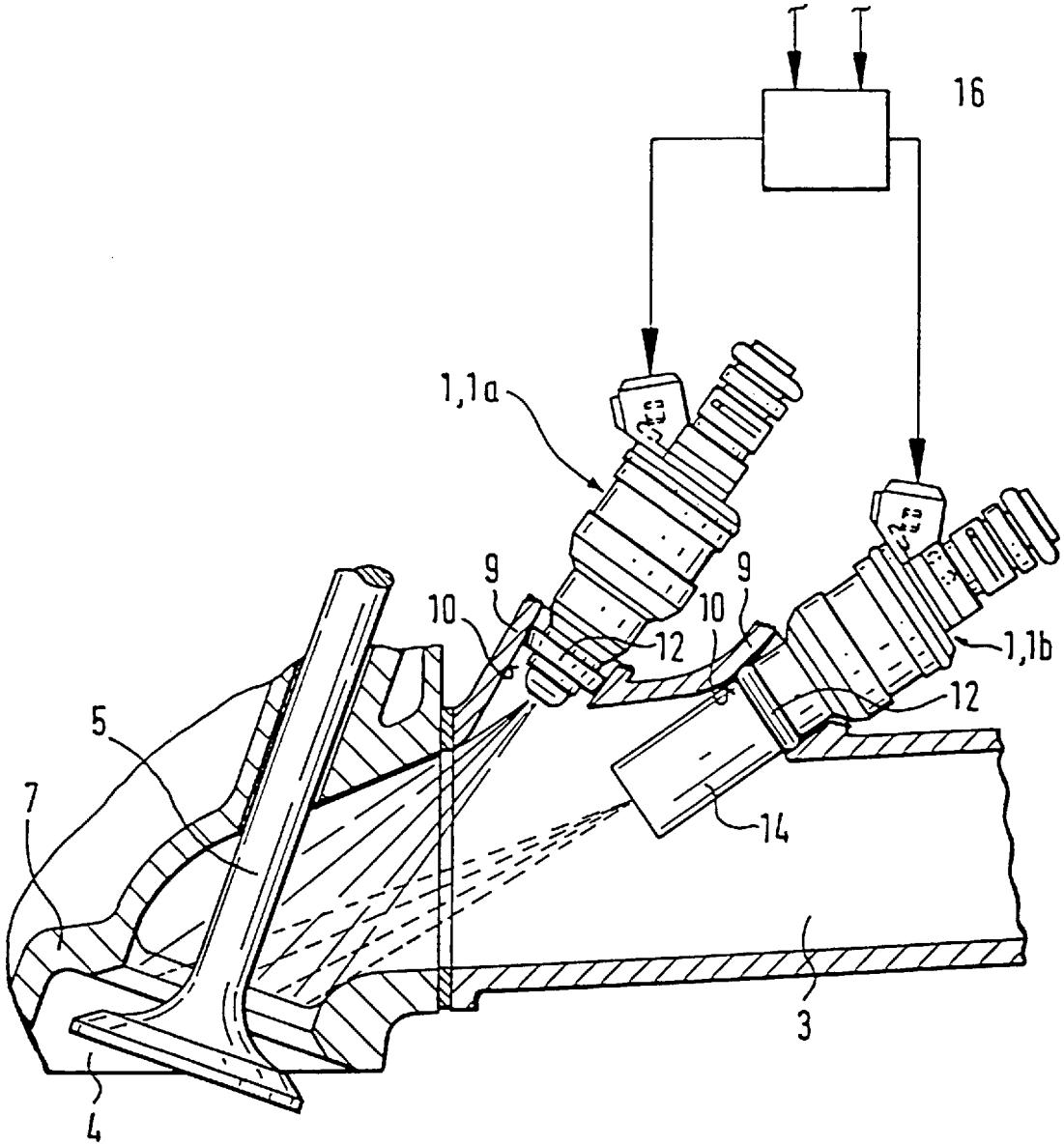
16
1,1a
9
10
12
9
10
1,1b
12
5
7
14
3
4

INJECTION ARRANGEMENT FOR AN INTERNAL COMBUSTION ENGINE AND METHOD FOR FUEL INJECTION

FIELD OF THE INVENTION

The present invention relates to a fuel injection arrangement for an internal combustion engine and a method for fuel injection.

BACKGROUND OF THE INVENTION

From European Patent No. 0 337 763, a fuel injection arrangement for an internal combustion engine is already known, in which several through-passages are provided in a common housing, in each of which one electromagnetic fuel injection valve device is arranged, for a total of two or more. A device for forming a magnetic shield is placed between each of two adjacent fuel injection valve devices. The fuel injection arrangement is structured in such a way that fuel can be injected in two directions with the fuel injection valve devices arranged in a housing, namely in the direction of two inlet valves of a cylinder of the internal combustion engine. An intake pipe which runs to a cylinder in each instance ends with two branch channels, whose access to the cylinder is opened or closed by means of the inlet valves. A branch channel can be closed by means of a closing device arranged upstream from the inlet valve. In accordance with the load status of the internal combustion engine, for example, only one branch channel is supplied with fuel in this way, so that fuel is only injected into the cylinder via one inlet valve. The inlet valves open and close synchronously in accordance with the rotational movement of the crank shaft of the internal combustion engine. The fuel injection valve devices arranged in a the common housing are structured in completely similar manner.

From U.S. Pat. No. 5,146,897, a multi-point injection with several fuel injection valves for injecting fuel into an internal combustion engine with several cylinders is already known. However, the fuel injection arrangement provides that fuel is injected into four inlet channels which run in the direction of several cylinders, using at most two injection valves. Therefore, in terms of numbers, at most one injection valve is assigned to one cylinder of the internal combustion engine. This fuel injection valve arrangement cannot react to different load conditions of the internal combustion engine, since excitation of the fuel injection valves takes place synchronously.

A heater adapter for a fuel injection valve, which is used to evaporate or atomize fuel, is already known from German Patent No. 44 12 448. This known heater adapter can be set onto the nozzle head of a fuel injection valve, with a seal that is pressure-proof. The embodiment of the heater adapter is a so-called fissure heater, in which profiled evaporator contact plates and PTC heating elements are arranged in a sandwich, so that a plurality of evaporator spaces (fissures) is obtained. If the fuel injection valves are equipped with such heater adapters, which are structured as open fissure heaters with good heat transfer, clear reductions in the emissions of non-combusted hydrocarbons (HC) can be achieved during cold start and in the warm-up phase of the internal combustion engine when the heater is in operation, as opposed to fuel injection valves without a heater adapter. This is particularly important in view of the stricter exhaust gas limits to be implemented in the USA and Europe in the near future.

As long as the heater adapter is turned on, very good fuel treatment takes place, as a result of which low HC values are achieved, in an advantageous manner. If, however, the heater adapter is shut off, only insufficient fuel treatment takes place (poor discharge behavior), which does not reach the treatment quality of known fuel injection valves. Because of the geometry of the fissure heater, a labyrinth occurs for the fuel which is no longer heated, and because of its storage behavior, uniform atomization is no longer possible. The non-uniform droplet size is particularly disadvantageous since the fuel can run together to form relatively large drops. On the other hand, if the heater were operated continuously, the burden on the electrical system of a vehicle would be too great. A vehicle generator would have to provide an enormous output of approximately 2 kW merely for operating the heater adapters, which appears unrealistic for practical purposes, so that continuous use of such a heater adapter is precluded, to a great extent.

From European Patent No. 0 661 445, a fuel injection arrangement is already known which is formed by a fuel injection valve and a fuel heater element, among other things. The fuel injection valve can be operated both without and with a heater element preceding it. In order to bring the fuel outlet of the fuel injection valve into the correct contact position with the heating element at the desired times, a complicated mechanism, i.e. an additional mechanical slide device is required. Particularly because of the constant contact of this mechanism with the aggressive intake pipe atmosphere, there is a high risk of deposits (plugging, lead sulfate), so that this slide mechanism appears very susceptible to damage. These deposits can result in jamming of the mechanism, particularly if the mechanism was not in use for some time. The moving parts of the slide mechanism are subject to dangerously high wear, particularly in view of the desired long lifetime of the fuel injection arrangement.

SUMMARY OF THE INVENTION

The fuel injection arrangement according to the present invention, has the advantage that a fuel injection system is created in simple manner, which makes it possible to achieve very good fuel treatment with low exhaust gas values both during cold start and during the warm-up phase of an internal combustion engine, by using an evaporator device/a heater, and to maintain very good quality of the fuel treatment during the other operating states of the internal combustion engine, without any additional stress on the internal combustion engine. This is achieved, according to the present invention, in that two fuel injection valves are arranged on an intake pipe which leads to a combustion space, where one of the two fuel injection valves includes an evaporator device, particularly a fissure heater as a heater adapter.

It is particularly advantageous to structure the heater adapter in the form of a fissure heater, in which a plurality of evaporator spaces is formed. In an advantageous manner, the fissure heater can have profiled contact plates and heater elements, which are arranged in the form of a sandwich. Both PTC and NTC elements as well as porous material or whisker material or heating layers on ceramic carriers can serve as the heater elements.

It is furthermore advantageous if the fuel injection valves are aligned in such a way that the fuel vapor given off, i.e. the injected fuel, is aimed directly at the at least one inlet valve, and undesirable wetting of the wall of the intake pipe is avoided.

Another advantage consists of the, fact that no complicated mechanism, susceptible to damage, is needed to put the heater into operation, but instead fuel injection valves are used which have a long lifetime and have been sufficiently tested.

The method according to the present invention, for fuel injection, has the advantage that very good fuel treatment is guaranteed in all operating states of the internal combustion engine. While the fuel injection valve with the evaporator device, i.e. the heater adapter, is operated during cold start and the warm-up phase of the internal combustion engine, and the fuel injection valve without the heater is in operation only during full load, and otherwise is out of operation, switching the fuel injection valves over takes place at a certain point in time, which can be determined on the basis of the value of various operating parameters of the internal combustion engine. The two fuel injection valves are therefore generally operated one after the other, where for non-stationary load changes the exception can occur that the two fuel injection valves are also operated at the same time, until the fuel injection valve with the heater adapter is shut off.

BRIEF DESCRIPTION OF THE DRAWING

The FIGURE shows a schematic representation of a fuel injection arrangement for an internal combustion engine, in the region of the intake pipe and the cylinder head of the internal combustion engine.

DETAILED DESCRIPTION

The present invention relates to a fuel injection arrangement with two fuel injection valves, one per combustion space of an internal combustion engine. In the FIGURE, a corresponding fuel injection arrangement is shown in part, in simplified form. The fuel injection valves 1 are not shown in detail, since many different types of known injection valves, particularly so-called electromagnetically activated top-feed injection valves, can be used for this fuel injection arrangement.

The fuel injection arrangement according to an embodiment of the present invention essentially comprises two fuel injection valves 1*a* and 1*b*, which are arranged on an intake pipe which is formed as a single intake pipe 3, which leads to a combustion space 4 of the internal combustion engine, directly in front of at least one inlet valve 5 of this combustion space 4. Via the single intake pipe 3, which has a circular cross-section, for example, the intake air for the internal combustion engine is made avoidable, where the amount of air is controlled via a throttle element, not shown, upstream from the fuel injection valves 1 in the single intake pipe 3. The fuel injection valves 1*a* and 1*b* are attached to the single intake pipe 3 and aligned in such a way that the fuel to be injected is aimed essentially directly at the inlet valve 5, and not at the walls of the single intake pipe 3 or a cylinder head 7, in which the inlet valve 5 is arranged, and with which the single intake pipe 3 is rigidly connected. It is also possible that instead of the one inlet valve 5, two inlet valves 5 are provided in the cylinder head 7 per combustion space 4. Then so-called two-jet valves will be used as fuel injection valves 1. To hold the fuel injection valves 1*a* and 1*b* securely, connectors 9 with passage apertures 10 are formed on the single intake pipe 3, with the fuel injection valves 1*a* and 1*b* projecting into them. For an effective seal between the fuel injection valves 1*a* and 1*b* and the connectors 9, seal rings 12, e.g. O-rings, are provided.

The two fuel injection valves 1*a* and 1*b* differ mainly in one point, namely that one of the two fuel injection valves 1*b* has a heater adapter 14 structured as an evaporator device, which is attached, for example, at the downstream end of the fuel injection valve 1*b*. The heater adapter 14 projects at least partly into the single intake pipe 3, so that a seal can be made on the single intake pipe 3 above the heater adapter 14, using the seal ring 12. The evaporator device 14 can certainly also be attached at a different location of the fuel injection valve 1*b*, not shown. For the remainder, the fuel injection valves 1*a* and 1*b* can be similar in structure.

In the drawing, the fuel injection valve 1*a* without the heater adapter is provided closer to the cylinder head 7 and therefore also closer to the inlet valve 5; however, an arrangement in which the fuel injection valve 1*b* with the heater adapter is attached closer to the inlet valve 5, while the fuel injection valve 1*a* without the heater adapter is arranged farther away, is also possible. Since fuel injection takes pace mainly via the fuel injection valve 1*a*, in terms of time, the arrangement shown in the drawing is particularly well suited and practical. The demands on the installation space for the fuel injection valve 1*b* with the heater adapter 14 are not as great. The fuel injection valve 1*b* with the heater adapter 14 should be heat-uncoupled from the single intake pipe 3 by means of a suitable material selection or sizing of the wall thicknesses.

The heater adapter 14 of the one fuel injection valve 1*b* is shown only schematically and will not be described in greater detail here, since known arrangements can be used for it, such as those listed in German Patent No. 44 12 448. This embodiment of the heater adapter 14 is a so-called fissure heater, in which profiled evaporator contact pates and heater elements are arranged in a sandwich. A plurality of evaporator spaces formed in it permits very good heat transfer and very good fuel treatment by means of evaporation of the fuel. The evaporator structure has PTC or NTC elements, for example, in other words resistance heater elements with positive or negative temperature coefficients, where the evaporator structure is housed in a housing. The heater elements can also be formed by using porous materials, whisker materials or sintered materials, in the form of wire coils or heating layers on ceramic carriers.

In the fuel injection arrangement described, the fuel injection valve 1*b* with the heater adapter 14 is the one almost exclusively in use during cold start and the warm-up phase of the internal combustion engine, where liquid fuel is provided, which can quickly reach the heater adapter 14. There, the liquid fuel is evaporated and driven out, i.e. blown out of the evaporator region of the heater adapter 14, by means of the volume change during the transition into the vapor phase, and brought to just in front of the combustion space 4, into the single intake pipe 3, in order to reach the combustion space 4 together with the air taken in.

In this manner, the emission of non-combusted hydrocarbons can be reduced to such a great extent, particularly during cold start and the warm-up phase, that very low exhaust gas values can be achieved. This makes it possible to fulfill the stricter exhaust gas limits in the USA (ULEV) and in Europe (MVEG III) which will go into effect in the near future. After the end of the warm-up phase, fuel injection by the fuel injection valve 1*b* is interrupted, and a switch is made to the fuel injection valve 1*a* without the heater adapter. In general, it is not planned to operate the two fuel injection valves 1*a* and 1*b* at the same time; instead, the electromagnetically activated fuel injection valves 1 are put into operation one after the other, using an electronic control device 16. In exceptional cases, such as non-stationary load changes, if the maximum output of the internal combustion engine must be reached during a very short period of time, and very quick changes of the throttle element take place, both fuel injection valves 1*a* and 1*b* can also be operated at the same time, with this being controlled, once again, by the control device 16. If large amounts of fuel are needed, injection therefore takes place both via the fuel injection valve 1*b* with a large basic amount, and via the fuel injection valve 1*a* with a smaller residual amount.

Fuel injection via the fuel injection valve 1*a* in the direction of the inlet valve 5 therefore usually does not start until immediately after the fuel injection valve 1*b* is shut off. Usually, the time during which the fuel injection valve 1*b* is in operation, and therefore fuel evaporation in the fuel injection valve 1*b*, will take about 60 to 90 seconds during a cold start. Afterwards, only unheated fuel is injected via the fuel injection valve 1*a*. Switching operation from one fuel injection arrangement 1 to the other can take place according to different criteria, where the time of switching could be reached, for example, if the catalytic converter (not shown), which serves for treatment of the exhaust gases, has reached its conversion temperature. The electronic control device 16 receives countless measurement values in the form of electrical signals, relating to operating values of the internal combustion engine, for example the speed of rotation, the load according to the angle of rotation of the throttle element, the oxygen concentration in the exhaust line, the conversion temperature of the catalytic converter, and other values, which are evaluated very quickly and result in the desired switch between the fuel injection valves 1 by means of the appropriate control. In order to guarantee optimum treatment of the fuel to be injected via the fuel injection valve 1*a* even after the switch is made, the fuel injection valve 1*a* can be equipped with additional measures, such as a gas surround or a preceding atomizer screen, in known manner.

What is claimed is:

1. A fuel injection arrangement for an internal combustion engine, comprising:

at least one intake pipe leading to at least one combustion space;

at least one inlet valve arranged between the at least one combustion space and the at least one intake pipe; and at least two fuel injection valves assigned to each of the at least one combustion space, independent of a number of the at least one inlet valve, the at least two fuel injection valves opening into the at least one intake pipe, at least one of the at least two fuel injection valves including an evaporator device; the at least one of the at least two fuel injection valves injecting a fuel vapor into the at least one intake pope .

2. The fuel injection arrangement according to claim 1, wherein the evaporator device includes a heater adapter arranged at a downstream end of the one fuel injection valve.

3. The fuel injection arrangement according to claim 2, wherein the heater adapter has a fissure heater shape, in which a plurality of evaporator spaces are formed.

4. The fuel injection arrangement according to claim 1, wherein a first fuel injection valve of the at least two fuel injection valves is positioned further downstream on the intake pipe than a second fuel injection valve of the at least two fuel injection valves, and wherein the first fuel injection valve does not include the evaporator device and the second fuel injection valve includes the evaporator device.

5. The fuel injection arrangement according to claim 1, further comprising:

an electronic control device for controlling an operation of the at least two fuel injection valves as a function of operating parameters of the internal combustion engine.

6. A fuel injection arrangement for an internal combustion engine, comprising:

at least one intake pipe leading to at least one combustion space;

at least one inlet valve arranged between the combustion space and the intake pipe; and at least two fuel injection valves assigned to each of the at least one combustion space, independent of a number of inlet valves, the at least two fuel injection valves opening into the at least one intake pipe, at least one of the at least two fuel injection valves being provided with an evaporator device for emitting a fuel vapor;

wherein the at least two fuel injection valves are aligned such that the fuel vapor is emitted directly at the at least one inlet valve, away from walls of the intake pipe.

7. A method for injecting fuel into an internal combustion engine having at least one combustion space, at least one intake pipe, and at least two fuel injection valves, the at least one intake pipe leading to the at least one combustion space, the at least two fuel injection valves opening into the at least one intake pipe, the method comprising the steps of:

configuring one of the at least two fuel injection valves to inject a fuel vapor into the at least one intake pipe, the one of the at least two fuel injectors valves including an evaporator device; and injecting fuel into each of the at least one combustion space via the at least two fuel injection valves, the at least two fuel injection valves corresponding to the at least one combustion space.

8. The method according to claim 7, further comprising the steps of:

operating the one fuel injection valve which emits the fuel vapor for 60 to 90 seconds during a cold start of the internal combustion engine;

operating, subsequent to the operating of the one fuel injection valve which emits the fuel vapor, another fuel injection valve, without an evaporator device, of the at least two fuel injection valves; and switching, under control of an electronic control device operating under at least one processed parameter of the internal combustion engine, between the operating of the one fuel injection valve which emits the fuel vapor and the another fuel injection valve without the evaporator device.

9. The method according to claim 7, further comprising the steps of:

operating the one fuel injection valve which emits the fuel vapor for 60 to 90 seconds during a cold start of the internal combustion engine;

operating, at the same time as the operation of the one fuel injection valve which emits the fuel vapor, if additional fuel is needed, another fuel injection valve without an evaporator device of the at least two fuel injection valves;

operating, subsequent to the operation of the one fuel injection valve which emits the fuel vapor, the another fuel injection valve without the evaporator device; and controlling, with an electronic control device, the at least two fuel injection valves on the basis of at least one operating parameter of the internal combustion engine processed by the electronic control device.

10. The method according to claim 9, wherein a larger amount of fuel is injected via the one fuel injection valve which emits the fuel vapor than via the another fuel injection valve without the evaporator device.

11. A method for injecting fuel into an internal combustion engine having at least one combustion space, at least one intake pipe, and at least two fuel injection valves, the at least one intake pipe leading to the at least one combustion space, the at least two fuel injection valves opening into the at least one intake pipe, the method comprising the steps of:

structuring one of the at least two fuel injection valves such that it emits a fuel vapor;

injecting fuel into each of the at least one combustion space via the at least two fuel injection valves, the at least two fuel injection valves corresponding to the at least one combustion space;

operating the one fuel injection valve which emits the fuel vapor for 60 to 90 seconds during a cold start of the internal combustion engine;

operating, subsequent to the operating of the one fuel injection valve which emits the fuel vapor, another fuel injection valve, without an evaporator device, of the at least two fuel injection valves; and switching, under control of an electronic control device operating under at least one processed parameter of the internal combustion engine, between the operating of the one fuel injection valve which emits the fuel vapor and the another fuel injection valve without the evaporator device;

wherein the step of switching takes place when a catalytic converter, which treats exhaust gases, has reached a conversion temperature.

* * * * *

UNITED STATES PATENT AND TRADEMARK OFFICE

CERTIFICATE OF CORRECTION

PATENT NO. : 5,850,822
DATED : Peter Romann, Klaus-Henning Krohn, JörgLange,
INVENTOR(S) : Christof Vogel
Dec. 22, 1998

It is certified that error appears in the above-indentified patent and that said Letters Patent is hereby corrected as shown below:

Column 5, line 46, "intake pope" should be --intake pipe--.

Signed and Sealed this

Fifth Day of October, 1999

*Attest:*

*Attesting Officer*

Q. TODD DICKINSON

*Acting Commissioner of Patents and Trademarks*